US005915768A

United States Patent [19]

Young

[11] Patent Number: 5,915,768

[45] Date of Patent: Jun. 29, 1999

[54] YARD WASTE BAGGING MEANS

[76] Inventor: Roger L. Young, 2515 High School Dr., Brentwood, Mo. 63144

[21] Appl. No.: 09/065,279

[22] Filed: Apr. 23, 1998

Related U.S. Application Data

[60] Provisional application No. 60/044,968, Apr. 28, 1997.

[51] Int. Cl.[6] ..... B65B 67/04

[52] U.S. Cl. ..... 294/1.1; 248/95; 15/257.1

[58] Field of Search ..... 294/1.1, 55; 141/108, 141/109, 337, 390, 391; 248/95, 97, 99; 15/257.1, 257.3, 257.9

[56] References Cited

U.S. PATENT DOCUMENTS

| | | | |
|---|---|---|---|
| 176,555 | 4/1876 | Scholfield . | |
| 2,939,614 | 6/1960 | Hill | 141/337 |
| 3,936,087 | 2/1976 | Alexander | 294/1.1 |
| 3,983,914 | 10/1976 | Benson | 294/1.1 |
| 4,312,531 | 1/1982 | Cross . | |
| 4,749,011 | 6/1988 | Rylander . | |
| 5,090,756 | 2/1992 | Pfisterer | 294/1.1 |
| 5,220,554 | 6/1993 | Taniwa . | |
| 5,226,554 | 7/1993 | Dauphinais | 248/97 |
| 5,271,589 | 12/1993 | Belous . | |
| 5,593,117 | 1/1997 | Alexander, III . | |
| 5,765,614 | 6/1998 | Kardosh | 141/390 |

*Primary Examiner*—Dean Kramer
*Attorney, Agent, or Firm*—Paul M. Denk

[57] ABSTRACT

A yard waste bagging device, for use in combination with polyethylene, paper, or other bags, includes a sheet of polymer material, cut into a rectangular form, and which may be folded into the cylindrical form, and through the use of a fastener secure the side edges of the sheet into its cylindrical configuration. An upper funnel or coned shaped device is also cut from a sheet of polymer or other material, it includes a band of such material, has a segment cut from its ends, the ends are fastened together through the use of a fastening device, to form a funnel, cone, or the like. A series of integral fasteners extend downwardly from the lower edge of the funnel, and may be formed having a barbed configuration, and then insert or connect to the upper edge of the cylindrical device, to form a funnel shaped cylinder member. That member can then be slid into a polyethylene or paper bag, or corresponding size, erected on end, for the deposit of leaves, grass, or other refuse therein, or it can be laid on its side, to allow for the direct raking of such yard waste into the bagging device, and once filled, stood on its end, packed, the cylinder device can be removed, providing a yard bag fully packed with such waste, for further disposal.

7 Claims, 3 Drawing Sheets

YARD WASTE BAGGING MEANS

RELATED APPLICATIONS

This application is related to Provisional Application Serial No. 60/044,968 filed Apr. 28, 1997, which is incorporated herein by reference.

BACKGROUND OF THE INVENTION

Attempting to accumulate yard waste, whether it be leaves, grass, mulch, or any other materials, and package it for either waste disposal, for shipment, or transfer to some other area of the yard, or to the front of the yard for waste pickup, has always been a problem. Efforts to simply bag leaves, once they have been raked into a pile, generally entails and requires at least two to three workers, to achieve such. There have been some mechanisms made that have assisted in the process, and for example, a cardboard box, with a bag surrounding it, has been available in the art, to assist in the packaging of grass, and the like for achieving disposal of such refuse. In addition, various types of compost kits, generally comprising a walled vessel, usually aerated through the location of a variety of perforations, and having a lid for covering the same, has been available in the art, but this is primarily available for more permanent usage, located at the back of the yard, where compost can be gathered, collected, and composted, over a period of time.

The current invention remedies some of the problems associated with the collection of such yard refuse, facilitates the gathering of the leaves, grass, and the like, within its container, and can be readily installed for usage, and disassembled, leaving bagged yard waste material for either disposal, or for composting purposes.

SUMMARY OF THE INVENTION

This invention relates generally to the bagging of yard waste material, and more specifically, pertains to means to facilitate the collection of yard waste, by only a single individual, and which invention can be manipulated easily by the worker, during its application and usage.

It is the principal object of this invention to provide means to facilitate the gathering, collection, and bagging of yard waste material, such as leaves, grass, and the like, through the usage of an easily assembled accessory product.

This invention contemplates the formation and erection of a yard waste bagging means, that is generally comprised of only two components. Initially, it incorporates a cylindrical means, generally having the same height as the bag into which the leaves are to be raked, and which can be assembled from a flattened planar condition, into a cylindrical form, held into its circular configuration by means of fastening means, and then incorporates an upper funnel-like means that secures, temporarily, to the upper edge of the cylinder means, in order to facilitate the collection of the leaves, disposition of them into the associated yard bag, and generally without much spillage, during the usage and application of this development.

The bagging means of this invention is used in conjunction with the standard yard bags, whether they be of the forty gallon size, or the like, with the dimensions of this bagging device being designed so that it can be fabricated of differing sizes, to accommodate the type of yard bags normally used by the homeowner. The subject matter of this invention is to provide a bagging means that can eliminate the difficulty of putting leaves into a yard bag, simply because it is difficult to hold the top of the bag opened, during deposit of leaves into the bag, and to hold the bag upright, during performance of such work.

The bagging means of this invention is very advantageous, when used, because its lower cylindrical means holds the polymer or paper yard bag opened, and in an erect position, and through the usage of the top funnel or cone-shaped means that can readily receive the deposit leaves, grass, and other yard waste directly into the bag, without too much effort.

The two parts of this invention, as previously alluded to, include a large flattened sheet of polymer, that may be within the vicinity of 0.050 inches, more or less, in thickness, in order to add substantial strength to its usage, when assembled, but at the same time, not be too heavy to allow for its disassembly, and manipulation back into the flattened condition, when it is desired to store the bagging means of this invention, for subsequent usage. The flattened sheet of polymer includes, upon both of its side edges, various fastening means, that facilitate its rolling into the cylindrical form, and holding of its edges in proximity and adjacency, when assembled, so as to maintain the cylindrical means in that configuration, when the bagging means is used. These fastening means may undertake various configurations, such as, there may be a series of slits provided along the left side edge of the sheet means, while barbed shaped fastening means are provided punched from the opposite edge, so that the barbed means may insert within these slots, when assembled, to hold the bagging means into its cylindrical form and shape, when assembled for usage.

The second segment of the bagging means includes its designed cone or funnel shaped means. This is precut or punch stamped from a similar type of polyethylene or other polymer material, as previously alluded to, which polyethylene sheet is generally cut into a circular form, and includes a series of centrally oriented and directional shank portions, that point towards the center of the circular sheet, and which are stamped into this configuration, when fabricated. An outer band of the circular sheet is cut, segmentally, over approximately a 90° degree angle, or less, and at one end of the band is included a series of slots, radially disposed, while the opposite end of the band includes another shank-like barbed portion, shaped into the configuration of an arrowhead, whereby the two ends of the band can be pulled together, to form a cone or funnel, as can be understood, and held in this position through the assembly of the barbed means into the adjacent slots, to provide a securement of the circular means and its band into a generally funnel or cone shaped configuration. Then, to complete the assembly of the device, the shanks and barbs that are radially arranged and pointed centrally inwardly of the band, insert through slots provided proximate the upper edge of the cylindrical means, in order to form a cylinder with a connected funnel shaped means arranged thereabove, to facilitate the usage of this bagging means when employed.

When the bagging means is assembled as previously described, it can be lined and have inserted therein a polyethylene or other type of polymer bag, or a paper bag, and the waste is then inserted into one of such yard wastes bags, and the entire combination is then stood on an end, with the funnel shaped means directed upwardly, ready for usage for the further deposit of leaves, and the like, therein, during application.

As is also available through usage of the bagging means of this invention, the entire assembly, once it has been located within a bag, can be laid on its side, and the funnel-like means collapses slightly at that location where it contacts or is arranged contiguously with the ground, so that leaves or grass can then be raked directly up onto the funnel-like means, and pushed into the bag, for collection.

Once that is achieved, or once the bag is reasonably filled, it can be stood on end, to provide for a packing downwardly of the leaves and grass, within the bag, for further filling. Once the bag is completely filled, to capacity, the bagging means of this invention may be simply slid upwardly, removed from the polymer or paper bag, and under this condition, the bag can simply be closed at the top, and otherwise secured or held closed by means of a twister, or the like, for cartage or other disposition.

Hence, it is a primary object of this invention to provide a bagging means that greatly facilitates the bagging of leaves, grass, and the like, when employed.

Another object of this invention is to provide a bagging means that can be used by one individual, and without requiring participation of any other workers.

Still another object of this invention is to provide a bagging means that may be fabricated from a polymer, assembled from two components that are generally of flattened configuration, for ease of storage, or quickly assembled into the configuration of the bagging means of this invention, for ready usage.

Another object of this invention is to provide a bagging means that may be easily stored, within a minimum of space.

Still another object of this invention is to provide bagging means that may be die cut or stamped from sheets of polymer material, rather promptly.

Still another object of this invention is to provide a bagging means that is easy to assemble, and facile of usage.

Yet another object of this invention is to provide a bagging means that is relatively inexpensive of manufacture.

These and other objects will become more apparent to those skilled in the art upon reviewing this summary of the invention as provided herein, and particularly when undertaking a study of the description of the preferred embodiment, in view of the drawings.

BRIEF DESCRIPTION OF THE DRAWINGS

In referring to the drawings, FIG. 1 discloses the bagging means of this invention as located within a yard waste bag.

DESCRIPTION OF THE PREFERRED EMBODIMENT

Figure 1:
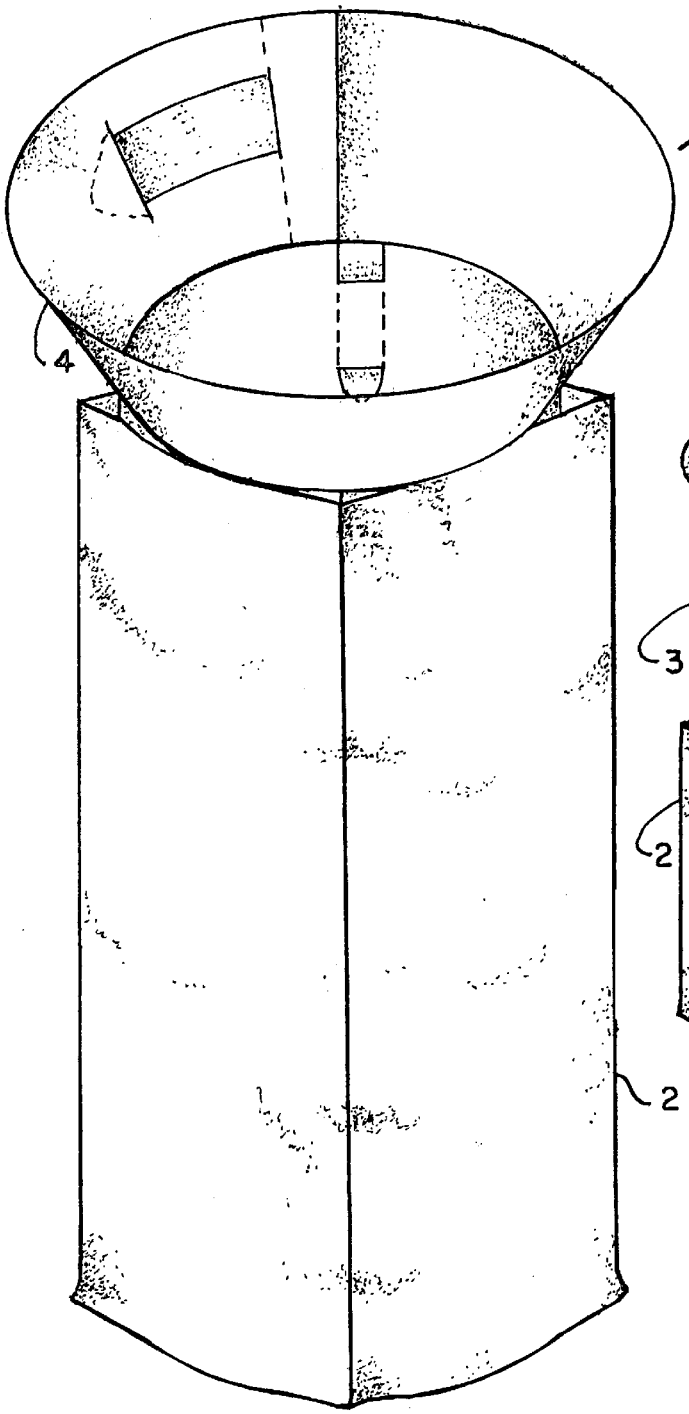

In referring to the drawings, and in particular FIG. 1, the yard waste bagging means of this invention is disclosed, set up ready for usage. As can be seen, the bagging means 1 of this invention is designed for inserting within one of the standard size bags 2, whether it be of the type that is fabricated from paper, a polymer, such as polyethylene, or other material, and normally used for the collection and retention of yard waste, in the category of leaves, grass, and the like. Usually, these bags come in varying sizes, but predominantly the largest as found available at the hardware stores are in the vicinity of a 30 to 40 gallon capacity bags.

Figure 3:
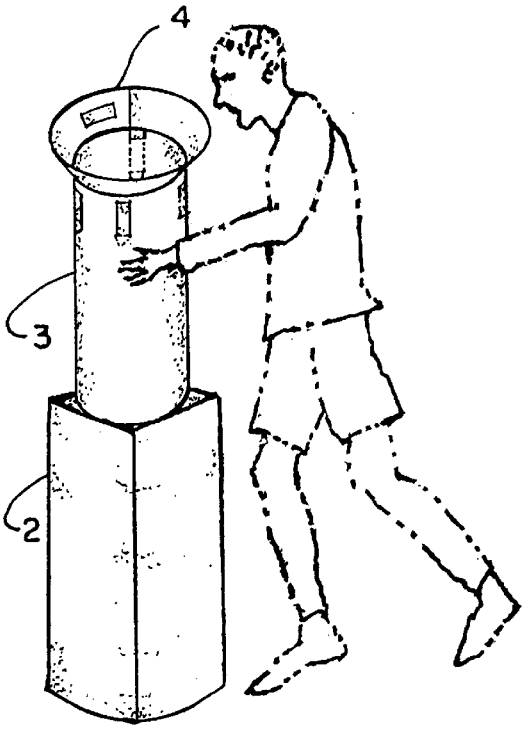
FIG. 3 shows the ease of assembly of the bagging means of this invention while being inserted within a yard waste bag in preparation for usage, or showing how the bagging means can be easily slid upwardly and free from the yard waste bag, once it has been filled with grass and leaves.
Figure 4:
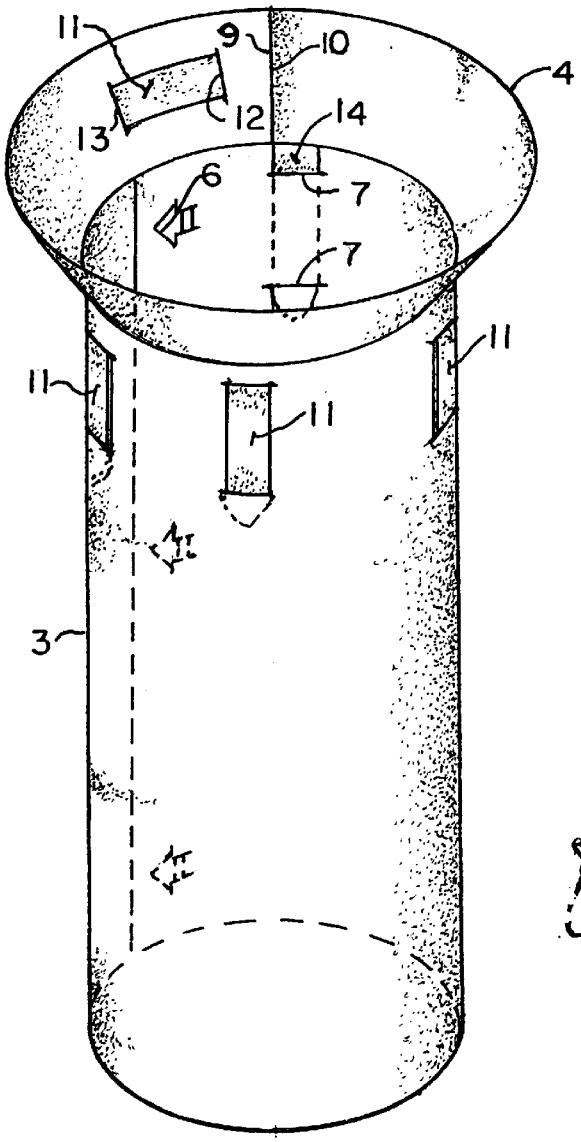
FIG. 4 shows the assembled bagging means of this invention.
Figure 5:
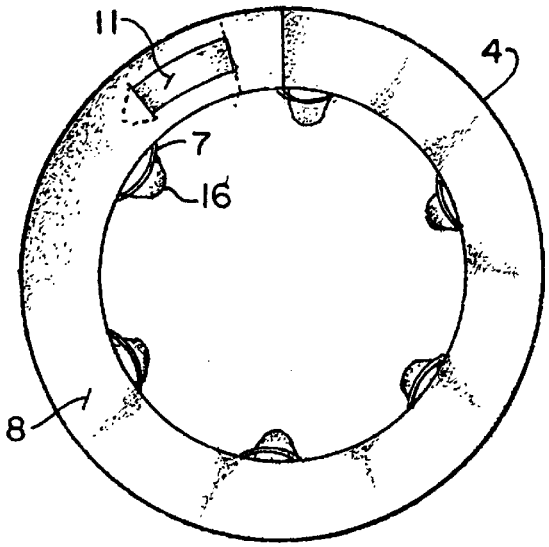
FIG. 5 is a top plan view thereof.

As can be seen in FIG. 4, the bagging means of this invention includes its cylindrical portion or member 3, and it has connected thereto a cone or funnel shape member 4, temporarily affixed to its upper end. This combination, when assembled, as can be seen, provides a height corresponding to the height of the bags with which it is to be used in association, and the device can be slid directly into the bag, when assembled for usage, in the manner as can be seen in FIG. 3.

Figure 2:
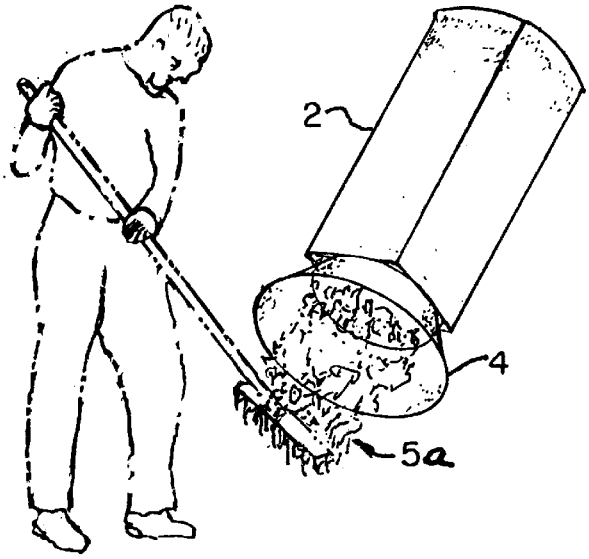
FIG. 2 shows the bagging means of this invention being employed, as resting laterally upon its side, or receiving raked leaves or grass.

When the device has been assembled for usage, and the cylindrical means and its cone are slid downwardly into the bag, yard refuse such as leaves, grass, and the like can be deposited therein, or the entire assembly can be laid on its side, in the manner as seen in FIG. 2, and leaves and grass can be raked directly into the device, as noted. When in this position, as noted in FIG. 2, usually the cone 4 will slightly collapse, as at the vicinity of 5*a*, where it contacts the ground, and offers a function similar to that of a dust pan, or the like, that allows the grass and leaves to be raked directly thereon, and into the cylindrical portion 3, during deposit of the yard refuse.

Once the combination of the bagging means and the bags are filled to capacity, the worker simply need to erect the combination on its end, once again, as seen in FIG. 3, raise the bagging means out of the bag, the yard waste will remain within the bag, ready for fold down the upper edge of the bag, in preparation for disposition of such waste.

Figure 6:
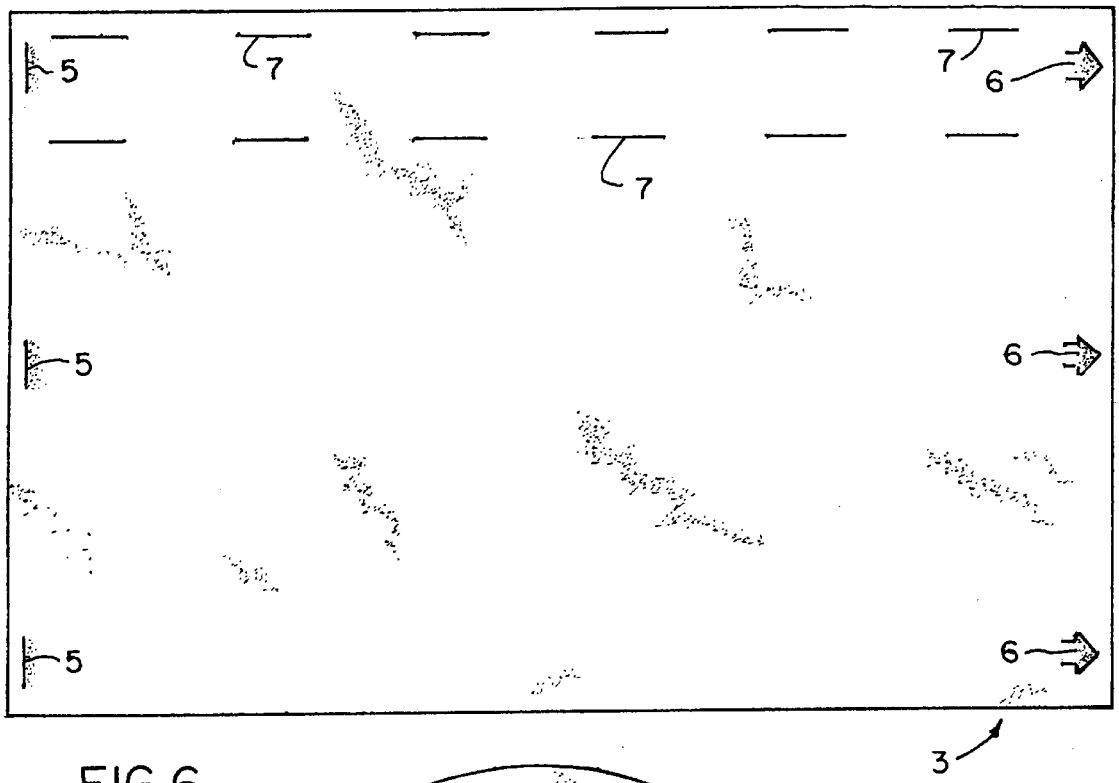
FIG. 6 shows, in blank form, the polymer shaped and stamped configuration of that component of the bagging means of this invention that is assembled into the cylindrical means.
Figure 7:
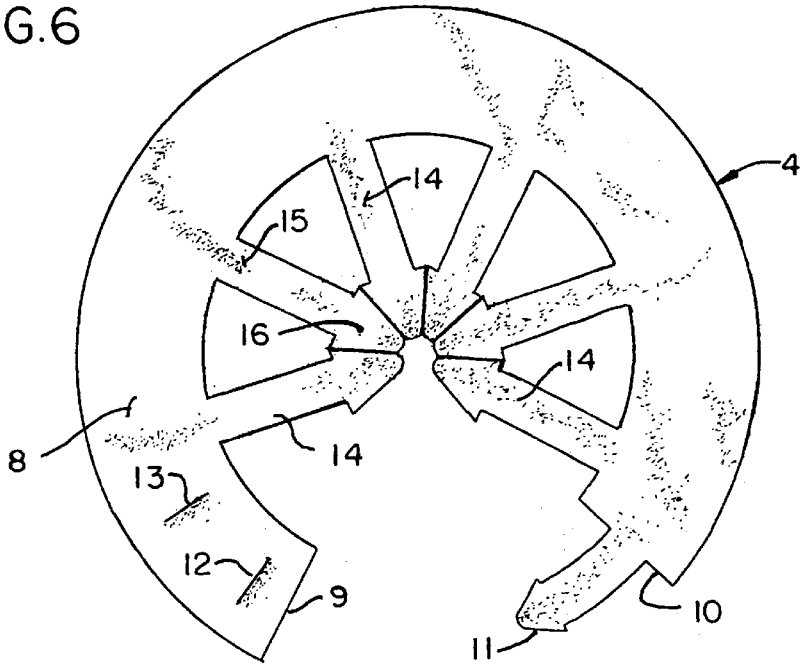
FIG. 7 shows, in the blank form, the configuration of the funnel means, and its various fastening devices, before it is formed into the cone shape, or secured to the upper end of the cylinder means of this invention.

The components of the bagging means of this invention can be readily seen in FIGS. 6 and 7, in their collapsed state. As noted, the cylindrical means 3 is formed of a flattened piece of material, such as a high density polyethylene sheet, and using sheet material in the range of 0.050 thickness has been found satisfactory. This provides sufficient flexibility for the cylindrical means to be folded, into the cylinder form, and yet have sufficient strength to withstand the rigors of usage, when collecting yard waste. In the preferred embodiment, the cylindrical portion of the bagging means stands approximately thirty-four inches tall, but obviously, heights greater or lesser than that can be used, depending upon the height of the bag in which it is employed. The length of the cylinder sheet, in its blank form, is approximately fifty-four inches long, as noted. The entire sheet may be cut to these or approximate dimensions, as during preparation, and then various vertical slits, as at 5, are provided along one edge, while retention means in form of the arrows, as noted at 6, are provided adjacent the opposite edge of the sheet. Thus, when the cylindrical means 2 is rolled into the cylinder form, the punched shape retention means, in the form of the arrow 6, are slid into the aligned slots 5, and pushed forcefully therein, so as to retain the cylinder into its rolled condition.

In addition, there are a series of slots 7 provided adjacent the upper edge of the sheet 3. These are for use for cooperating with fastening means associated with the funnel 4, in a manner to be described.

The funnel-shaped means 4 is generally disclosed, in its blank form, in FIG. 7. Once again, the funnel means may be die cut, into the configuration as shown, and as normally cut from the similar type of polyethylene sheets as previously explained. In addition, it also is maintained in the flat form, as is the cylinder portion 3, when not being used. Thus, this facilitates the storage of the bagging means, when unemployed. The funnel 4, as noted, includes an outer ring-like segment 8, which is cut into a sector, or has a segment, as between the edges 9 and 10, cut therefrom. The edge 10 incorporates, though, an extended portion 11, which also has an arrowhead or barbed configuration, as noted, and when the funnel member is shaped into a cone configuration, the member 11 inserts through a pair of slots 12 and 13, adjacent the opposite edge 9 of the segment 8, in order to hold the segment into the cone or funnel shaped configuration, as can be seen in FIG. 1.

Projecting radially, inwardly, from the segment 8, are a series of additional fastening means 14. These segments include a length of shank portion 15, and each having a barbed or arrowhead configuration 16 provided at their inward end. These particular fastening means 14 are designed for being bend downwardly, and inserting through the various slots 7, provided through the upper edge of the sheet member 3, after it is formed into the cylindrical shape. Thus, the fastening means 14 provide for retention of the funnel shaped member 4, adjacent the upper edge of the cylindrical member 3, during usage. But, when it is desired to disassemble the device, these fastening means 14 can be removed, and likewise, the fastening means 11 can be removed from its corresponding slots 12 and 13, to allow the funnel shaped member 4 to undertake the flattened configuration, for storage. In addition, the fastening means 6, associated with the cylindrical member 3, are removed from their corresponding slots 5, to allow the cylinder to expand into the flattened configuration, to allow for its storage, as during nonuse.

The concept of this invention is obviously designed to provide means for facilitating the raking of leaves, grass, and other yard waste into a yard bag, usually a feat that is difficult to perform, particularly when the homeowner or yard man is working alone. The advantage of utilizing a funnel shaped means adjacent the upper end of the cylinder holds the yard bag in an opened condition, affords a top cone or funnel shaped member upwardly, to facilitate and make it easier to put yard waste into the bag. The setup, and disassembly, of the bagging means of this invention can be easily performed, individually, as previously reviewed.

Variations or modifications to the subject matter of this invention may occur to those skilled in the art upon review of the description of the invention provided herein. Such variations or modifications, if within the spirit of the invention described herein, are intended to be encompassed within the scope of this disclosure. The description of the preferred embodiment, and the illustrations of the invention as set forth in the drawings, are provided for illustrative purposes only.

I claim:

1. A yard waste bagging device for use with a bag, the bagging device comprising:

a cylindrical member having a length at least as long as the height of the bag, and a circumference less than the circumference of the bag;

the cylindrical member being formed from a one-piece, generally rectangular blank, the blank having a first edge, a second edge, a top edge, and a bottom edge, at least one slit adjacent the first edge, at least one locking member adjacent the second edge, which is slidably passable through the slit to hold the blank in the cylindrical form, and a plurality of slits adjacent the top edge;

a truncated cone removably securable to the cylinder, the cone being formed from a one-piece blank;

the cone blank having a generally ring configuration with a segment removed therefrom, the ring having an upper outer edge, and a lower inner edge, a first side edge and a second side edge, a slit adjacent said first side edge of the cone blank, a locking member adjacent said second side edge of the cone blank and sized to be removably slidable through said first side edge slit to form said blank into said ring configuration, and a plurality of connectors extending from said ring lower inner edge, said connectors being removably slidable through the top edge slits of the cylinder to removably attach the formed cone to the formed cylinder;

the locking members of the cone blank and the cylinder blank each comprise a shank and a head at the end of the shank, the head defining a triangle having a base with a length greater than the width of the shank.

2. The yard waste bagging device of claim 1 wherein the locking member of the cylinder is spaced inwardly from the second edge of the cylinder blank, the head of the locking member facing the second edge, the cylinder blank defining a margin between its second edge and the end of the cylinder locking member.

3. The yard waste bagging device of claim 2 wherein the locking member of the cone blank extends from the second edge of the cone blank.

4. The yard waste bagging device of claim 2 wherein the cone can be disconnected from the cylinder, and the cone and the cylinder can be disassembled for storage.

5. The yard waste bagging device of claim 1 wherein the cone connectors include a shank extending radially from the inner edge of said ring and a head at an end of said shank; said head defining a triangle having a base with a length greater than the width of the shank.

6. The yard waste bagging device of claim 1 wherein the cone and cylinder are made of plastic.

7. The yard waste bagging device of claim 6 wherein the plastic is about 0.050" thick.

* * * * *